United States Patent [19]

Robinson et al.

[11] 4,147,085

[45] Apr. 3, 1979

[54] ELECTRONIC ORGAN HAVING MEMORY CIRCUIT

[75] Inventors: John W. Robinson; Stephen L. Howell, both of Jasper, Ind.

[73] Assignee: Kimball International, Inc., Jasper, Ind.

[21] Appl. No.: 805,329

[22] Filed: Jun. 10, 1977

[51] Int. Cl.[2] ..... G10H 1/00; G10H 5/00

[52] U.S. Cl. ..... 84/1.17; 84/1.01; 340/365 S

[58] Field of Search ..... 84/1.01, 1.03, 1.17, 84/115, DIG. 22; 340/365 R, 365 S, 365 E

[56] References Cited

U.S. PATENT DOCUMENTS 4,011,784 3/1977 Fukui ..... 84/1.01

*Primary Examiner*—Stanley J. Witkowski

*Attorney, Agent, or Firm*—Albert L. Jeffers; John F. Hoffman

[57] ABSTRACT

An electronic organ having at least a portion of the keyboard connected with the corresponding keyers by a multiplexing system consisting of a multiplexer at the keyboard end of the system. A control circuit is interposed between the multiplexer and the demultiplexer and is selectively operable for interrupting the change of data in the demultiplexer and, instead, holding therein the data present in the demultiplexer at the time of actuation of the control circuit. The control circuit is adapted to be made ineffective at the will of the player, or by depressing a key in the aforesaid portion of the keyboard. The arrangement permits a player to hold the keyers pertaining to a group of keys from the portion of the keyboard without holding the keys depressed thereby permitting the player to use both hands elsewhere on the keyboard.

20 Claims, 4 Drawing Figures

ELECTRONIC ORGAN HAVING MEMORY CIRCUIT

BACKGROUND OF THE INVENTION

The present invention relates to electronic organs, and in particular, to electronic organs in which a portion of the data concerning depressed keys can be stored in a memory, on command, thereby permitting the player to use both hands elsewhere on the keyboard.

In many modern electronic organs, multiplexing techniques are employed for connecting at least a portion of the organ keyboard with the respective keyers. Such a system involves the scanning of the respective portion of the keyboard at a suitable scanning rate, say, 150 kilohertz, and the developing of a data stream by the multiplexer consisting of time displaced bits with signals corresponding to keys that were depressed at the time of the respective scan appearing in respective time slots of the data stream.

This data stream is supplied to a demultiplexer wherein the key-down signals in the stream are supplied to the input sides of latches for the corresponding latches, the outputs of which are connected to keyers for the respective tone signals. At the end of each such scan of the keys, the latches are updated by a pulse supplied by the multiplexer.

It is also known in such a system to provide detecting circuitry to detect the depression of a key in the multiplexed portion of the keyboard and to develop a signal in conformity therewith which will permit the flow of data to the demultiplexer. In all such systems, keys must be depressed to produce sounds except where automatic preset devices are employed for playing note patterns on command.

The present invention has as its primary objective the provision, in a multiplexed organ system, of a memory arrangement operable, upon command, to store in the demultiplexer the data corresponding to the keys which were depressed at the time of giving the aforesaid command.

When the portion of the keyboard normally played by the left hand is provided with the memory system, a player can depress the keys corresponding to a chord, and activate the memory system, and will then have both hands free to play elsewhere on the keyboard, as in the portion usually played only by the right hand. The arrangement thus adds substantial possibilities for the organ player.

BRIEF SUMMARY OF THE INVENTION

According to the present invention, at least a portion of the keyboard on an electronic organ is connected with the corresponding keyers by a multiplexing system consisting of a multiplexer at the keyboard end of the system and a demultiplexer at the keyer end of the system. The entire organ may be multiplexed in this manner if so desired.

In one of the systems, for example, in connection with the system pertaining to the accompaniment manual, namely, that portion of the organ keyboard that is normally played by the left hand, there is inserted a circuit component which, upon command, which can be brought about by actuation of a knee switch, for example, the changing, or updating, of the data supplied by the multiplexer to the demultiplexer is interrupted and, instead, the data already in the multiplexer is retained therein and holds the respective keyers in actuated condition.

In practice, the actual flow of data from the multiplexer to the demultiplexer need not be interrupted but, instead, the supply of the updating pulses to the latches in the demultiplexer are interrupted in order to freeze or memorize the data in the demultiplexer. In any case,, the data is memorized in the multiplexer on command, thereby permitting the organ player to release the keys while the note or chord pertaining thereto continues to sound.

The control circuit will deactivate upon command to resume the supply of data or latch pulses to the demultiplexer or the control circuit will become ineffective upon the depression of a key in the portion of the organ keyboard to which the control circuit pertains. When the key is depressed, a signal is supplied which makes the aforementioned control circuit ineffective for a predetermined length of time and during which time the latches in the demultiplexer are updated so that new data will be entered in the demultiplexer at the time the last mentioned signal ceases.

The exact nature of the present invention will become more clearly apparent upon reference to the following detailed specification taken in connection with the accompanying drawings in which.

DETAILED DESCRIPTION OF THE INVENTION

Figures 1, 2:
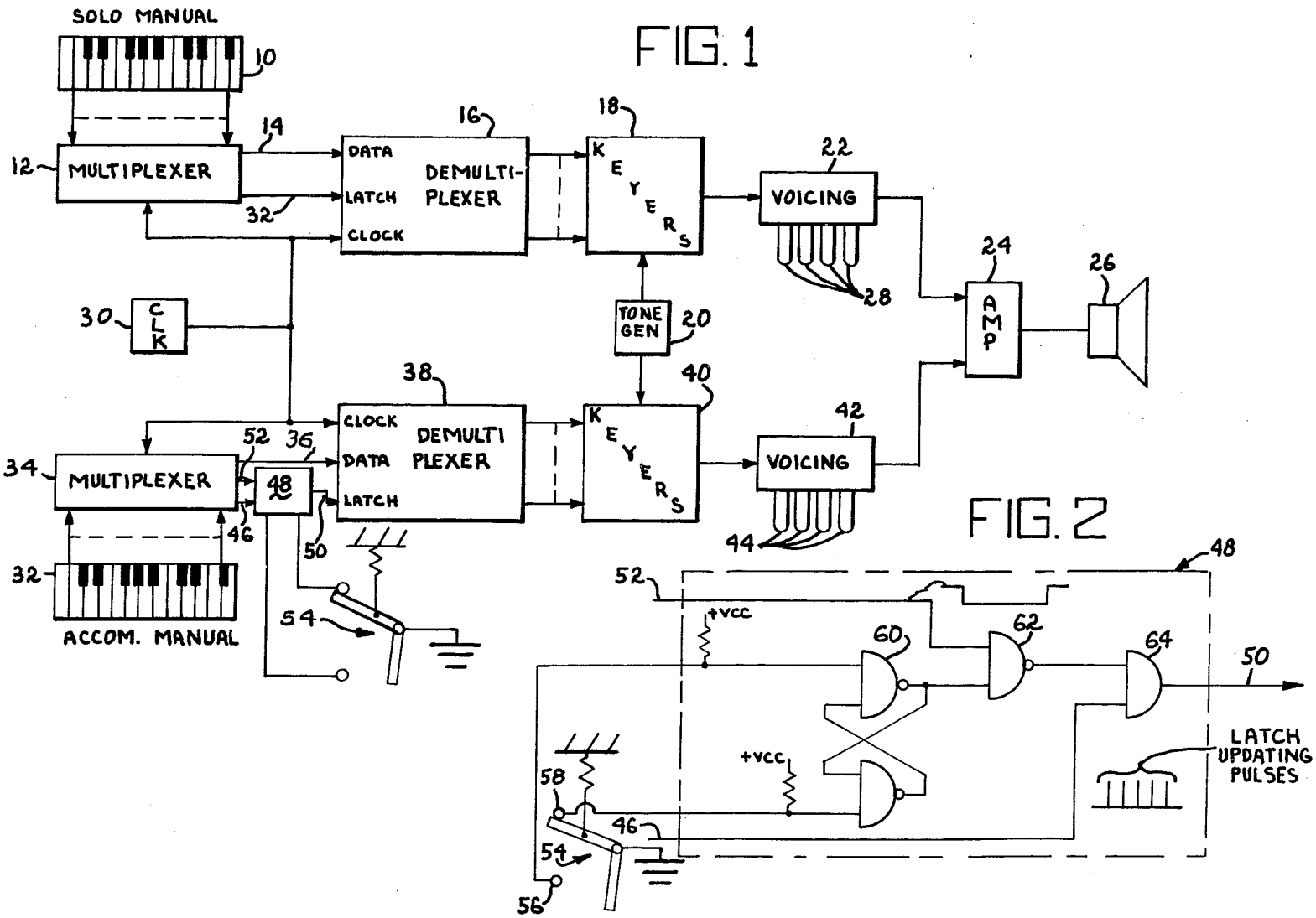
FIG. 1 is a schematic view showing the organ circuit having a memory system according to the present invention interposed between a multiplexer and demultiplexer pertaining to the lower or left hand manual of the organ.
FIG. 2 is a somewhat schematic view showing more in detail the control circuit or memory according to the present invention.

Referring to the drawings somewhat more in detail, in FIG. 1, reference numeral 10 indicates the upper manual of the organ, and which may be separate from the remainder of the organ keyboard, or it may merely comprise a portion of the keyboard which is normally played by the right hand. The keyboard is connected with a multiplexer 12 of substantially conventional nature which scans the keys of upper manual 10 and supplies a serial data stream to wire 14 consisting of time displaced bits with signals corresponding to depressed keys appearing in respective time slots of the serial data stream. The keys are scanned at a rate of, say, 150 kilohertz, and the scanning of the keys is repetitive.

The data is supplied by line 14 to a demultiplexer 16 which includes latches connected to keyers 18 which are interposed between a source of tone signals 20 and voicing circuit means 22 which, in turn, is connected via amplifier means 24 to transducer or speaker means 26. Tabs at 28 are provided for controlling the voicing circuit means 22.

The demultiplexer and multiplexer are supplied with clock pulses from a clock 30 to hold the multiplexing system in synchronization. Further, at the end of each scan of keyboard 10, multiplexer 12 supplies a pulse to wire 32 which updates the latches in the demultiplexer 16.

The organ comprises a left hand keyboard portion or manual 32 which is scanned by a multiplexer 34, also supplied by clock 30, with multiplexer 34 supplying data via line 36 to demultiplexer 38 having latches connected in controlling relation to keyers 40 which are interposed between the source of tone signals 20 and voicing 42 which, in turn, has its output connected to the input side of amplifier 24. As in connection with voicing circuit means 22, the voicing circuit means 42 is provided with control tabs 44 for making the voicing circuits therein selectively effective.

The multiplexer 34 supplies the latch updating commands to a line 46 which goes to the input side of control or memory circuit module 48, the output side of which is connected by wire 50 to the terminal of demultiplexer 38 to which the latch updating commands are supplied.

Multiplexer 34, or separate circuitry which, optionally, can be incorporated in the chip for multiplexer 34, supplies a signal to a line 52 whenever a key of the lower manual 32 is depressed.

control or memory circuit 48 normally permits updating latch commands to pass freely therethrough from line 46 to line 50 for normal and conventional operation of the pertaining multiplexing system. Control circuit 48 is adapted, however, to receive commands from a knee operated switch 54 which, when actuated, causes control circuit 48 to interrupt the flow of latch updating signals from line 46 to line 50. Upon release of switch 54 by the player's knee, circuit 48 will freely pass the latch updating signals from line 46 to line 50.

It will be evident that operation of knee switch 54 will selectively interrupt the updating of the latches pertaining to demultiplexer 38 thereby to freeze or memorize therein the data present in the latches at the time of actuating the knee switch. It will also be evident that release of the knee switch will permit the flow of latch updating pulses to be resumed so that normal operation will obtain.

The aforementioned signal supplied to line 52, which indicates that a key of manual 32 has been depressed, will cause control circuit 48 to become ineffective for interrupting latch updating commands for the duration of the signal. The signal on wire 52 will cause updating of the latches pertaining to demultiplexer 38 whether or not knee switch 54 is in effective position.

Turning now to FIG. 2, which shows the control circuit more in detail, knee switch 54 will be seen to have a normal position in engagement with the contact 58 and to be movable, as by the player's knee, into engagement with a contact 56. Release of switch 54 will, of course, cause return thereof to engagement with contact 58.

Each contact is connected to a source of voltage by a suitable resistor and also to a respective input of an R-S latch, generally indicated at 60 and consisting of a pair of NAND gates interconnected in a known manner. The output of latch 60 is supplied to one input of a further NAND gate 62, the output of which is connected to the input of an AND gate 64 and the output of which is connected to a wire 50. The other input of gate 64 is connected to wire 46 to receive latch updating commands from multiplexer 34.

The wire 52 which supplies a signal when a key is depressed in left hand keyboard portion 32 is connected to the other input of NAND gate 62. The key-down signal supplied by wire 52 will be seen to be a negative going pulse, as indicated in FIG. 2, of substantial duration, for example, the duration of several scans of keyboard 32 and up to a few milliseconds. More specifically, the signal supplied by wire 52 should be wide enough to permit at least one latch updating command on wire 46 to pass to wire 50 but should be sufficiently narrow so that, when the player depresses keys quite quickly, this information will be supplied to and latched in the latches pertaining to the demultiplexer without being erased by a further latch updating command.

The inherent operation of circuit 48 is as follows .

When switch 54 is in engagement with contact 58, a logic 0 on the lower NAND gate of R-S flip-flop 60 places a logic 1 on the upper NAND gate which, together with the logic 1 on the other input of the NAND gate from the +VCC bias, places a logic 0 on NAND gate 62. This produces a logic 1 on AND gate 64, which enables gate 64 and permits data on line 46 to pass. When switch 54 engages contact 56, R-S flip-flop 60 changes state thereby placing a logic 1 on NAND gate 62 which produces a disabling logic 0 on AND gate 64, except when a negative going pulse on line 52 is received.

It will be evident that the arrangement of the present invention is particularly adapted for use with the accompaniment manual of an organ, or with the portion of the organ keyboard normally played by the left hand, because incorporation of the system in that part of the organ keyboard permits the player to hold a chord while using both hands on the solo manual, or right hand portion of the keyboard.

However, the application of the system of the present invention is by no means limited to the particular arrangement shown and described herein but can be employed with any multiplexed keyboard arrangement at any place desired.

In respect of the multiplexing system which are schematically shown in the drawings, it will be understood that these systems are conventional. As mentioned, the multiplexer at the keyboard end of the system scans the keys and develops a data stream on each scan consisting of time displaced bits with signals corresponding to depressed keys in respective time slots thereof. During the interval between the end of one scan and the beginning of the next scan, the multiplexer supplies the updating pulse to the latches in the demultiplexer.

Figure 3:
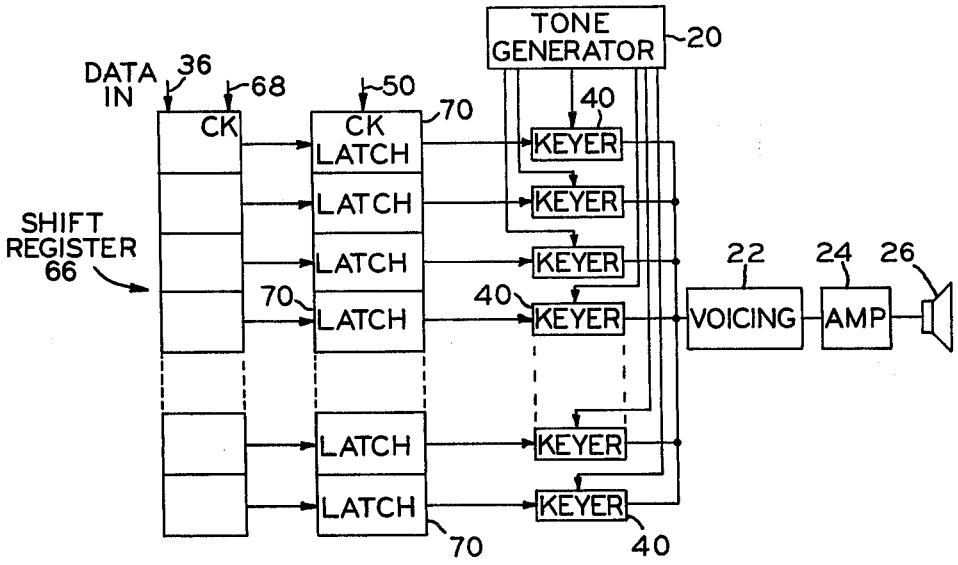
FIG. 3 is a schematic view showing the demultiplexer and keying arrangement in greater detail.

As shown in FIG. 3, the demultiplexer arrangement might consist of, for example, a shift register 66 to which the data stream is supplied over line 36 while being progressively shifted therealong by pulses on line 68 from the source of clock pulses 30 with a respective latch 70 interposed between each stage of the shift register 66 and a corresponding keyer 40. The data in each stage of the shift register 66 is presented to the input of the respective latch 70 and is supplied to the latch when the updating pulse on line 50 occurs and which updating pulse clocks all of the latches 70 at one time.

The data thus transferred from the shift register 66 into the latches 70 remains in the latches until the latches are again updated. The next following updating of the latches will occur during the interval following the end of the next scanning cycle of the keyboard 32.

From the foregoing brief description of a typical multiplexing system, it will be apparent that the interruption of the updating pulse supplied to the latches in the demultiplexer at the end of each scanning cycle will "freeze" or "memorize" the data present in the latches at the time of the interruption of the supply of latch updating pulses to the demultiplexer.

The flow of data conveyed by the aforementioned data stream from the multiplexer to the demultiplexer need not, itself, be interrupted and, instead, this data can be permitted to flow from the multiplexer to the shift register in the demultiplexer and be advanced therethrough because the data will be ineffective for controlling the latches unless the latches are clocked by the updating pulse referred to.

It is possible, of course, to interrupt the data flow simultaneously with the interruption of the supply of updating pulses if so desired, but the interruption of only the updating pulses is simpler and highly effective and requires the minimum additional circuitry.

Figure 4:
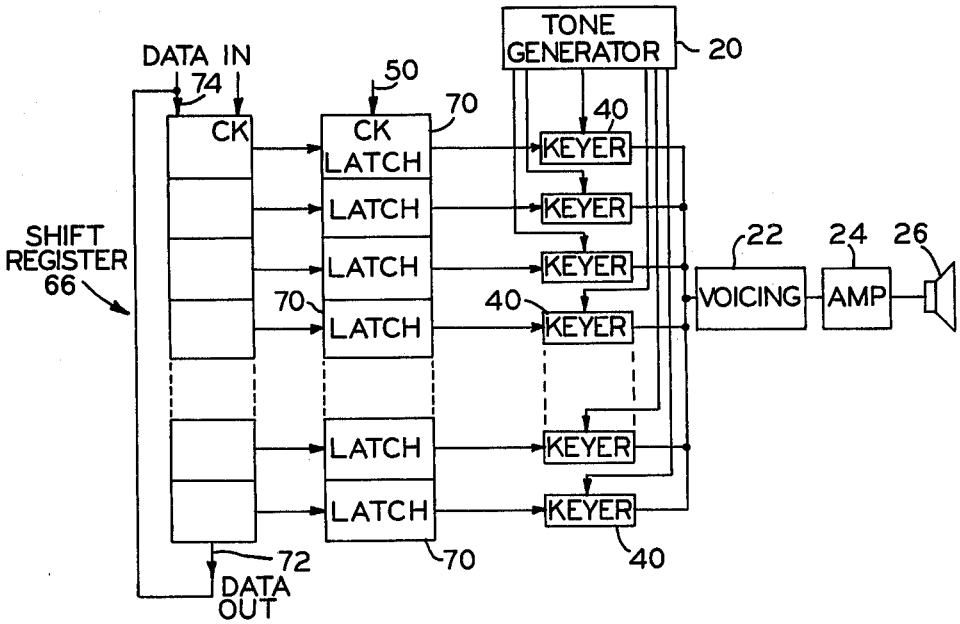
FIG 4 is a schematic view showing the demultiplexer and keying arrangement for a modified form of the invention.

In respect of the freezing or memorizing of the data in the accompaniment manual demultiplexer 38, it will be understood that, while a preferred method is the effecting of the freezing by interrupting the latch updating pulse, it is also possible to, as mentioned, actually interrupt the flow of data and to permit the latch updating pulses to continue with the data in the shift register 66 being caused to recirculate therethrough as shown in FIG. 4. In this case, the shift register 66 supplies the data stream from one end 72 back to the starting end 74 of the shift register 66 so that each time the latch updating on pulse occurs on line 50, excactly the same data will be transferred into the accompaniment manual demultiplexer latches 70.

Modifications may be made within the scope of the appended claims.

What is claimed is:

1. In an electronic organ having a pair of keyboard sections each having playing keys, multiplexer means repetitively scanning the playing keys of at least one of said sections and demultiplexer means connected to receive the data supplied by said multiplexer means, said demultiplexer means comprising latches which control the production of tones from the organ in conformity with the depression of the playing keys of said one section of the keyboard, said multiplexer means supplying a latch updating pulse to said latches at the end of each scanning cycle thereof, the improvement comprising control means interposed between said multiplexer means and said demultiplexer means and selectively operable by the organ player for interrupting said latch updating pulse so as to interrupt the updating of the data supplied from said multiplexer means to said demultiplexer means.

2. An electronic organ according to claim 1 which includes means for developing a control signal in response to the depressing of a playing key of said one section and means operable in response to said control signal for making said control means ineffective for the duration of at least one scanning cycle of said multiplexer means.

3. An electronic organ according to claim 1 in which said control means includes a gate having an output terminal connected to said demultiplexer means and an input terminal connected to said multiplexer means, said gate having another input terminal, and player operated means for supplying a disabling signal to said other input terminal of said gate to make said control means effective.

4. An electronic organ according to claim 1 in which said control means includes a gate having an output terminal connected to said demultiplexer means and an input terminal connected to said multiplexer means, said gate having another input terminal, and a source of disabling signal for said other input terminal of said gate.

5. An electronic organ according to claim 2 in which the duration of said control signal is equal to that of a plurality of scanning cycles of said multiplexer means.

6. The electronic organ according to claim 4 wherein said disabling signal is a pulse sufficiently wide to permit at least one latch updating pulse to pass through said gate.

7. An electronic organ according to claim 6 wherein said disabling pulse is of a duration of at least several scans of the keyboard.

8. In an electronic organ having a keyboard with playing keys and multiplexer means repetitively scanning said keys to develop a serial data stream of time displaced bits containing signals in respective time slots in conformity with depressed keys of the keyboard on each scan, demultiplexer means connected to receive data from said multiplexer means and including latches operated by said signals and controlling keyers for corresponding tone signals, said multiplexer means supplying a latch updating pulse at the end of each keyboard scan, the improvement comprising: control means interposed between said multiplexer means and demultiplexer means and selectively player operable for interrupting, for at least one complete scan of the keys, the supply of said latch updating pulses from said multiplexer means to said demultiplexer means.

9. An electronic organ according to claim 8 which includes means for developing a control signal in response to the depressing of a playing key, and means operable in response to said control signal for making said control means ineffective for the duration of at least one scanning cycle of said multiplexer means.

10. An electronic organ according to claim 8 in which said control means includes a gate having an output terminal connected to said demultiplexer means and an input terminal connected to said multiplexer means, said gate having another input terminal, and player operated means for supplying a disabling signal to said other input terminal of said gate to make said control means effective.

11. A method of playing an organ having groups of playing keys normally operated by the right and left hands respectively and wherein at least one of said groups of keys is connected to respective tone signal controlling keyers by a multiplexing system in which keyer actuating data is continuously developed and updated, said method comprising: selectively interrupting the updating of said system to retain the keyer actuating data therein which is present at the moment of interruption, and selectively resuming the updating of the system.

12. A method according to claim 11 which includes developing a control signal upon depression of a key of said one group, and making the interruption of the updating of the system ineffective for the duration of said signal.

13. A method according to claim 12 which includes scanning said one group of keys a plurality of times during the duration of said control signal.

14. A method according to claim 11 which includes resuming the updating of said system at will independently of the depression of a key of said one group of keys.

15. A method according to claim 11 in which the multiplexing system repetitively scans the keyboard and the interruption of the updating of said system occurs between the end of one scan and the initiation of the next following scan.

16. A method according to claim 11 in which the interruption of the updating of said system is accomplished by interrupting the supply of new data while simultaneously recirculating the data in the system at the instant of interrupting the updating of the system.

17. The method of operating an electronic organ in which a keyboard is repetitively scanned by multiplexing means, the data stream being developed on each scan consisting of time displaced bits with a signal corresponding to each depressed key being disposed in a respective time slot of the data stream, and supplying the data stream to a demultiplexer which includes a shift register through which the data stream passes in serial flow and latch means interposed between the shift register stages and keyers, and said data being updated at the end of each scan by an updating pulse from the multiplexer, the improvement in said method comprising: selectively generating a command operative for preventing insertion of new data into said latch means for a whole number of scans of the keyboard, even though said key is released.

18. The method according to claim 17 in which said command interrupts the supply of updating pulses to said latch means.

19. The method according to claim 17 in which said command interrupts the supply of fresh data to the demultiplexer and causes the data in the shift register thereof to recirculate.

20. In an electronic organ having a pair of keyboard sections each having playing keys, multiplexer means repetitively scanning the playing keys of at least one of said sections and demultiplexer means connected to receive the data supplied by said multiplexer means, said demultiplexer means comprising latches which control the production of tones from the organ in conformity with the depression of the playing keys of said one section of the keyboard, said multiplexer means supplying a latch updating pulse to said latches at the end of each scanning cycle thereof, the improvement comprising: control means interposed between said multiplexer means and said demultiplexer means and selectively operable by the organ player for interrupting, for a period of time equal to a whole number of scans of the playing keys, the updating of the data supplied from said multiplexer means to said demultiplexer means.

* * * * *

UNITED STATES PATENT AND TRADEMARK OFFICE

CERTIFICATE OF CORRECTION

PATENT NO. : 4,147,085

DATED : April 3, 1979

INVENTOR(S) : John W. Robinson and Stephen L. Howell

It is certified that error appears in the above-identified patent and that said Letters Patent are hereby corrected as shown below:

Col. 3, line 8, "means" omitted between "amplifier" and "24".

Col. 4, lin4 36, "system" should be "systems".

Col. 4, line 60, "70" omitted between "latches" and "will"

Col. 5, line 25. "on" before "pulse" should be deleted.

Signed and Sealed this

*Twenty-first* Day of *August 1979*

[SEAL]

*Attest:*

*Attesting Officer*

LUTRELLE F. PARKER

*Acting Commissioner of Patents and Trademarks*